US005944491A

United States Patent [19]

Yakomachi et al.

[11] Patent Number: 5,944,491

[45] Date of Patent: Aug. 31, 1999

[54] PISTON-TYPE COMPRESSOR WITH IMPROVED SHOCK ABSORPTION DURING START UP

[75] Inventors: Naoya Yakomachi; Satoshi Umemura; Hayato Ikeda; Takahisa Tokushige, all of Aichi-ken, Japan

[73] Assignee: Kabushiki Kaisha Toyoda Jidoshokki Seisakusho, Aichi-ken, Japan

[21] Appl. No.: 08/797,594

[22] Filed: Feb. 7, 1997

[30] Foreign Application Priority Data

Feb. 13, 1996 [JP] Japan ..... 8-025632

[51] Int. Cl.[6] ..... F04B 1/26

[52] U.S. Cl. ..... 417/213; 417/270

[58] Field of Search ..... 417/269, 270, 417/297, 213

[56] References Cited

U.S. PATENT DOCUMENTS 4,519,750 5/1985 Kurahashi et al. ..... 417/270

4,730,987 3/1988 Kawai et al. ..... 417/270

5,611,675 3/1997 Uchida et al. ..... 417/270

FOREIGN PATENT DOCUMENTS 61-72885 4/1986 Japan .

*Primary Examiner*—Timothy S. Thorpe

*Assistant Examiner*—Apollo Nguyen

*Attorney, Agent, or Firm*—Woodcock Washburn Kurtz Mackiewicz & Norris LLP

[57] ABSTRACT

An improved compressor that is designed to minimize shock and vibration during start-up includes a plurality of pistons, each of which is positioned for movement within a cylinder in order to compress a gas, and conventional motive structure for driving the pistons. Advantageously, the compressor includes a sensor for sensing, from a condition that exists within the compressor, when the compressor is in a start-up phase. The sensor is designed to be operative regardless of the position of the pistons during start-up. Pressure relief structure, responsive to said sensor, is provided for relieving pressure in at least one of the cylinders when the sensor indicates that the compressor is in the start-up phase. This minimizes shock and vibration during the start-up.

32 Claims, 4 Drawing Sheets

FIG. 2
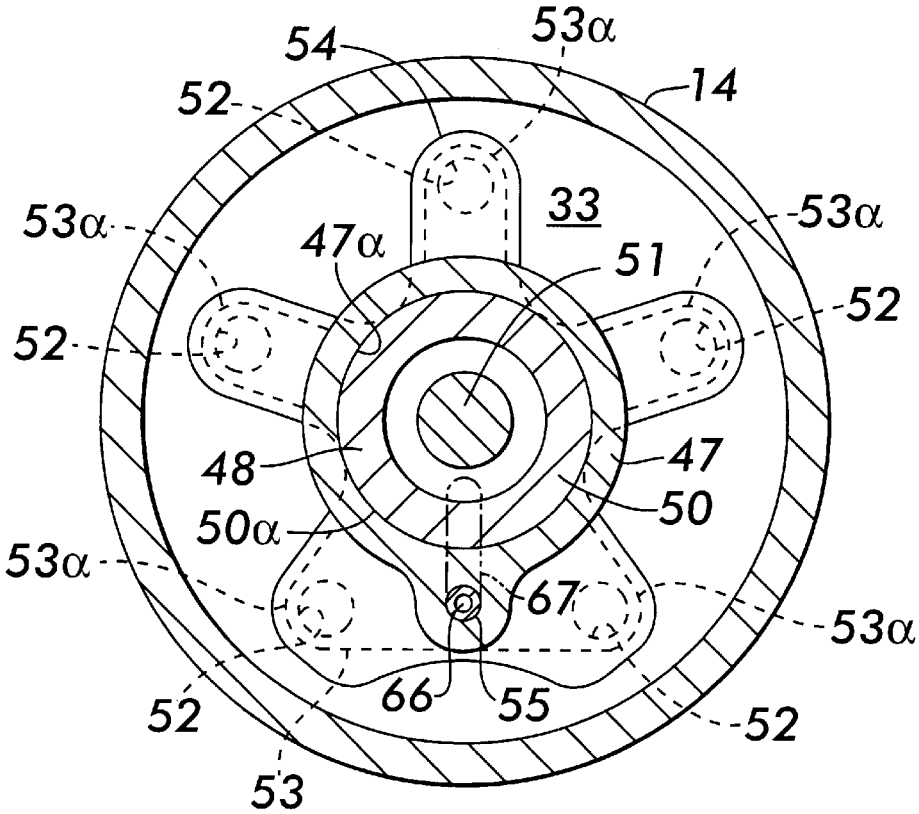
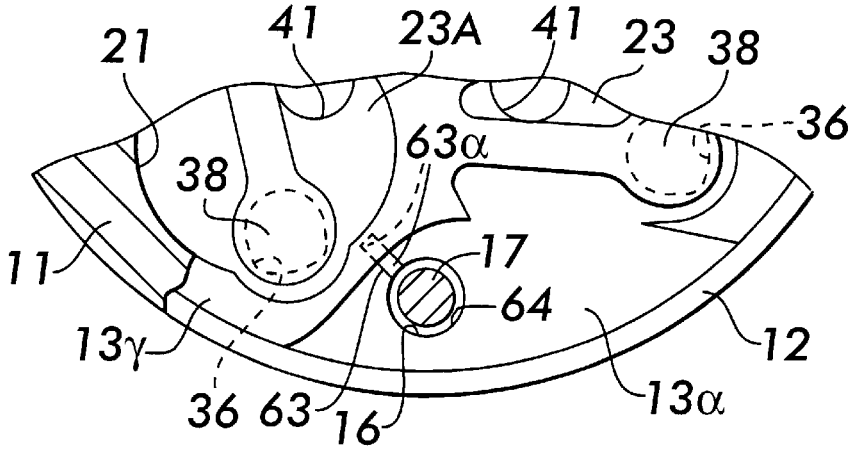
FIG. 3

FIG.4
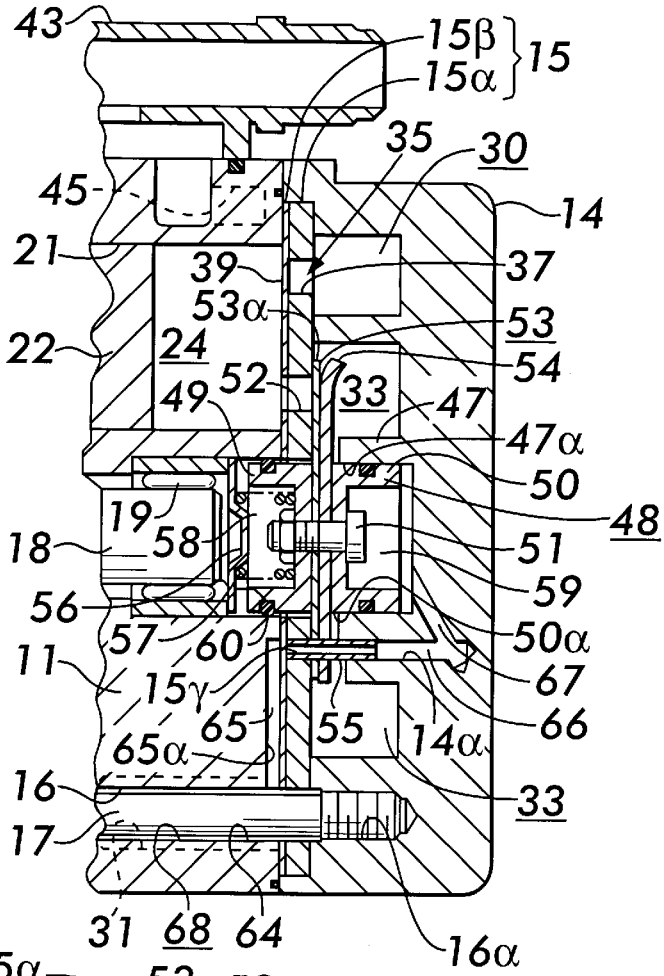
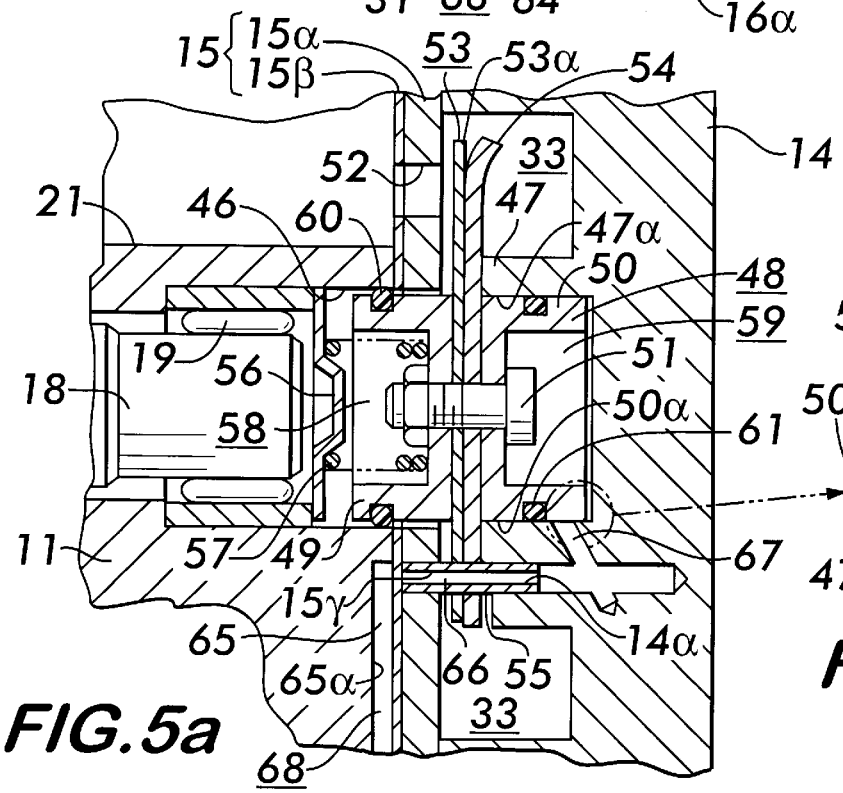
FIG.5a
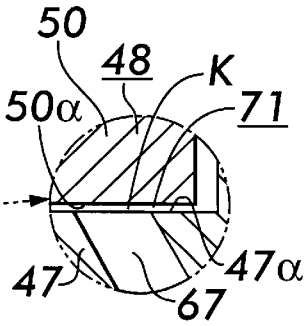
FIG.5b

FIG.6
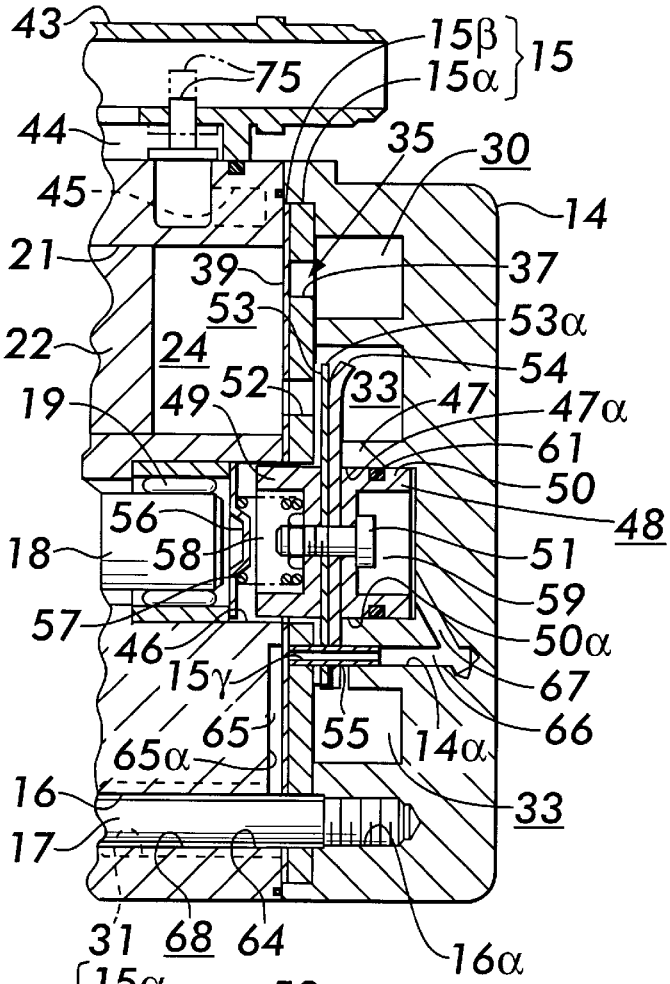
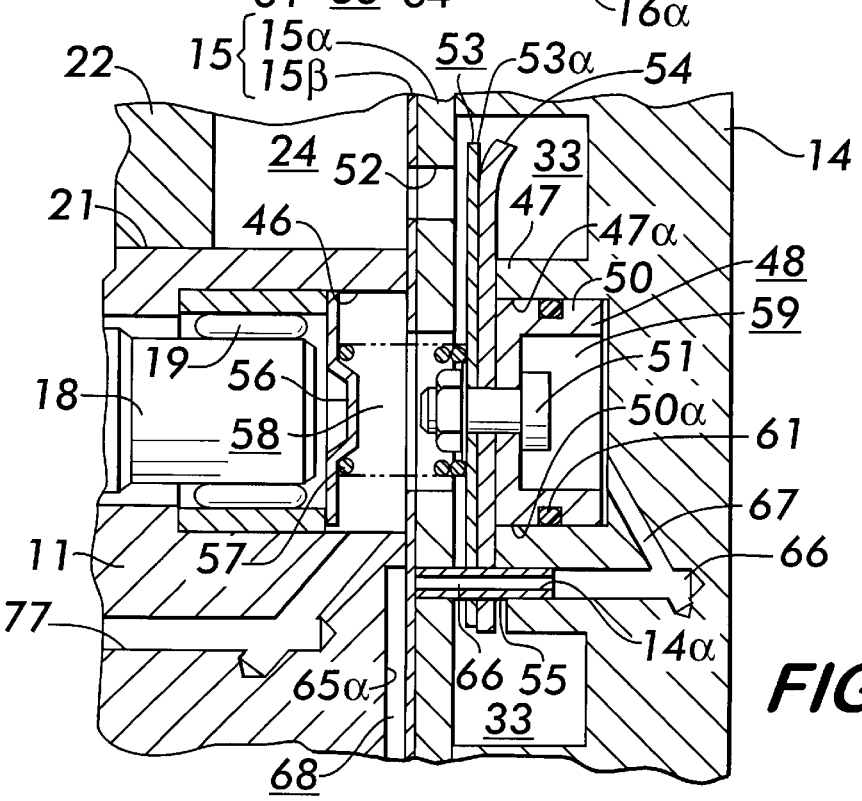
FIG.7

PISTON-TYPE COMPRESSOR WITH IMPROVED SHOCK ABSORPTION DURING START UP

BACKGROUND OF THE INVENTION

1. Field of the Invention

This invention relates generally to the field of piston-type compressors, such as the compressors that are commonly used in vehicle air conditioning systems. More specifically, this invention relates to a system that has been developed in order to minimize the shock and vibration that is typically associated with start-up operation in this type of compressor.

2. Description of the Related Technology

Generally, in a fixed-volume, twin-head piston compressor of the type that is used in automotive air conditioning systems, twin-head pistons are contained in the cylinder bores that are formed in a cylinder block. An intake chamber and a discharge chamber are formed in the front housing unit and the rear housing unit on a partitioned basis. The cooling medium gas inside the intake chamber is drawn in and compressed by the reciprocating motion of the pistons and is discharged into the discharge chamber.

In the twin-head piston compressor, the discharge holes are formed on the valve plate in correspondence with the cylinder bores. Fixed discharge valves, which are provided in correspondence with fixed discharge holes, are closed when the cooling medium gas is drawn in and are opened when the gas is discharged.

In such a compressor, when by engaging the clutch the compressor is mechanically connected to an external drive source, such as the vehicle engine, and the reciprocal motion of the pistons begins, the compression load on the compressor increases suddenly. In a vehicle-mounted compressor, the sudden change in compression load is transmitted to the external drive source, such as a vehicle engine, as a change in load torque. This can cause a change in the rpm of the vehicle engine. The change in rpm is called an on-off shock and imparts an unpleasant sensation to the passenger.

Moreover, when the compressor is started, a compression force sometimes acts on the liquid coolant that has been deposited in the cylinder bore. When the compressor assumes the liquid-compressed state, a high compression load acts upon the pistons and generates shock-like vibrations and noise.

In order to solve these problems, the present applicant has previously proposed a compressor equipped with a startup shock, an example of which can be found in Japanese Kokai patent S61-72885 (1986). In this compressor, moving discharge valves are provided in correspondence to the discharge holes located on the rear valve plate. The moving discharge valves operate in conjunction with the motion of the spool; they are moved on a switchable basis between the operating position, in which the valves come into contact with the discharge holes, and the non-operating position, in which the valves are at a distance from the discharge holes. A control chamber is provided on the back of the spool. A first electromagnetic valve is located on the pressure supply passage that connects the control chamber to the discharge pressure area. Similarly, a second electromagnetic valve is located on another pressure supply duct that connects the control chamber to the suction pressure area. When the compressor is started, the activation signal opens and closes, respectively, the first and second electromagnetic valves, connects the control chamber to the discharge pressure area, and shuts off the connection to the suction pressure area.

Consequently, the spool is moved by the discharge pressure supplied to the control chamber against the energizing force of the spring. This places the moving discharge valves, located in the non-operating position, in the operating position. When the compressor is stopped, the stop signal opens and closes, respectively, the first and second electromagnetic valves, connects the control chamber to the suction pressure area, and shuts off the connection to the discharge pressure area. Consequently, the pressure inside the control chamber is released to the suction pressure area and decreases. When the spool is moved by the energizing force of the spring, the moving discharge valves are moved to the non-operating position.

Thus, by placing the moving discharge valves in the non-operating position when the compressor is stopped, the normal compression operation is not performed in the compression chamber with which the moving discharge valves are associated for several seconds from the time the compressor is started until the moving discharge valves are transferred into the operating position. Consequently, the compression load that occurs during the activation of the compressor increases only gradually. This reduces both the unpleasant sensation that occurs when the clutch is engaged and the generation of noise and vibrations that stems from the compression of the liquid coolant.

The technology described above requires the provision of electromagnetic valves on the pressure supply passage as well as a control computer that controls the opening and closing operations of the electromagnetic valves according to compressor start/stop information. This adds complexity to the structure of the startup shock absorber and the compressor, thus increasing manufacturing costs.

A need exists for an improved piston-type compressor that is capable of reducing the compression load that acts on the pistons during start-up operation that is relatively inexpensive to manufacture and is effective regardless of the initial position of the pistons during start-up.

SUMMARY OF THE INVENTION

Accordingly, it is an object of the invention to provide an improved piston-type compressor that is capable of reducing the compression load that acts on the pistons during start-up operation, that is relatively inexpensive to manufacture and is effective regardless of the initial position of the pistons during start-up.

In order to achieve the above and other objects of the invention, an improved compressor that is designed so as to minimize mechanical disturbances such as shock and vibration during start-up includes a plurality of pistons, each of which is positioned for movement within a cylinder in order to compress a gas; motive structure for driving the pistons; a sensor for sensing, from a condition that exists within the compressor, when the compressor is in a start-up phase, the sensor being operative regardless of the position of the pistons; and a pressure relief system, responsive to the sensor, for relieving pressure in at least one of said cylinders when said sensor indicates that the compressor is in the start-up phase, whereby shock and vibration are minimized during the start-up.

A piston-type compressor that is constructed according to a second embodiment of the invention includes a housing unit that is joined and fixed to the edge of a cylinder block through valves; a plurality of cylinder bores, each of which holds a piston and is formed on the cylinder block; intake and discharge chambers that are constructed on a partition basis in the housing unit, such that the reciprocating motion of the pistons draws the cooling-medium gas from said intake chamber into a compressing chamber in the cylinder bore and, subsequently, the gas is pumped out into the discharge chamber through discharge holes that are formed on the valves; a spool support unit that is placed in the discharge chamber; a spool that is fitted onto and supported by the spool support unit and that can be moved relative to the valves in a direction in which the spool can move toward and away from the valves; moving discharge valves that are associated, on a detachable basis, with at least one of the discharge holes located on the valves and that, in tandem with said spool, can move between an operating position, in which the valves come into contact with the discharge holes, and a non-operating position, in which the valves are separate from the discharge holes; an energizer that energizes the spool so that the movable discharge valve is placed at the non-operating position; a first control chamber that is formed on the front side of the spool and that is connected to a suction pressure area; a second control chamber that is surrounded by the spool and the spool support unit and that is formed on a partitioned basis on the back side of the spool; a sealing unit that is placed between the coupling sides of the spool and the spool support unit and that seals the second control chamber and the discharge chamber; a pressure supply passage that connects the second control chamber to the compression chamber on the cylinder bore which is not associated with a movable discharge valve, such that, when the compressor is started, said pressure supply passage supplies the pressure inside the compression chamber to the second control chamber and, when the compressor is stopped, the pressure supply passage releases the pressure inside the second control chamber to the compression chamber; and a choke that is provided on the pressure supply passage.

A method of operating a piston-type compressor includes, according to a third aspect of the invention, steps of: (a) monitoring an average pressure at an upper dead point of a cylinder of the compressor to determine if the compressor is in a start-up mode; and (b) if the compressor is so determined to be in a start-up mode, relieving pressure in another cylinder of the compressor to reduce stress and vibration during start-up.

An improved compressor that is designed so as to minimize mechanical disturbances such as shock and vibration during start-up includes, according to a fourth aspect of the invention, a plurality of pistons, each of which are positioned for movement within a cylinder in order to compress a gas; motive structure for driving the pistons; sensing structure for sensing, from a condition that exists within the compressor, when the compressor is stopped, the sensing structure being operative regardless of the position of the pistons when the compressor is stopped; and pressure relief structure, responsive to the sensing structure, for relieving pressure in at least one of the cylinders when the sensing structure indicates that the compressor is stopped, whereby shock and vibration are minimized during the start-up.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

FIG. 2 is a lateral, partial cross-sectional diagram of the area around a moving discharge valve in the compressor of FIG. 1;

FIG. 3 is a lateral, partial cross-sectional diagram of the area around a front-side valve formation body in a compressor that is constructed according to the embodiment of FIG. 1;

FIG. 4 is an explanatory diagram showing the action of a moving discharge valve in the embodiment of FIG. 1;

FIG. 5*a* is an enlarged, vertical cross-sectional diagram of the area around a moving discharge valve in a compressor that is constructed according to a second embodiment of the invention;

FIG. 5*b* is an enlarged detail of the throttle passage according to the second embodiment shown in FIG. 5*a*.

FIG. 6 is an enlarged, vertical cross-sectional diagram of the rear of a compressor that is constructed according to a third embodiment of the invention; and FIG. 7 is an enlarged, vertical cross-sectional diagram of the area around a moving discharge valve in a compressor that is constructed according to a fourth embodiment of the invention.

DETAILED DESCRIPTION OF THE PREFERRED EMBODIMENT(S)

Figure 1:
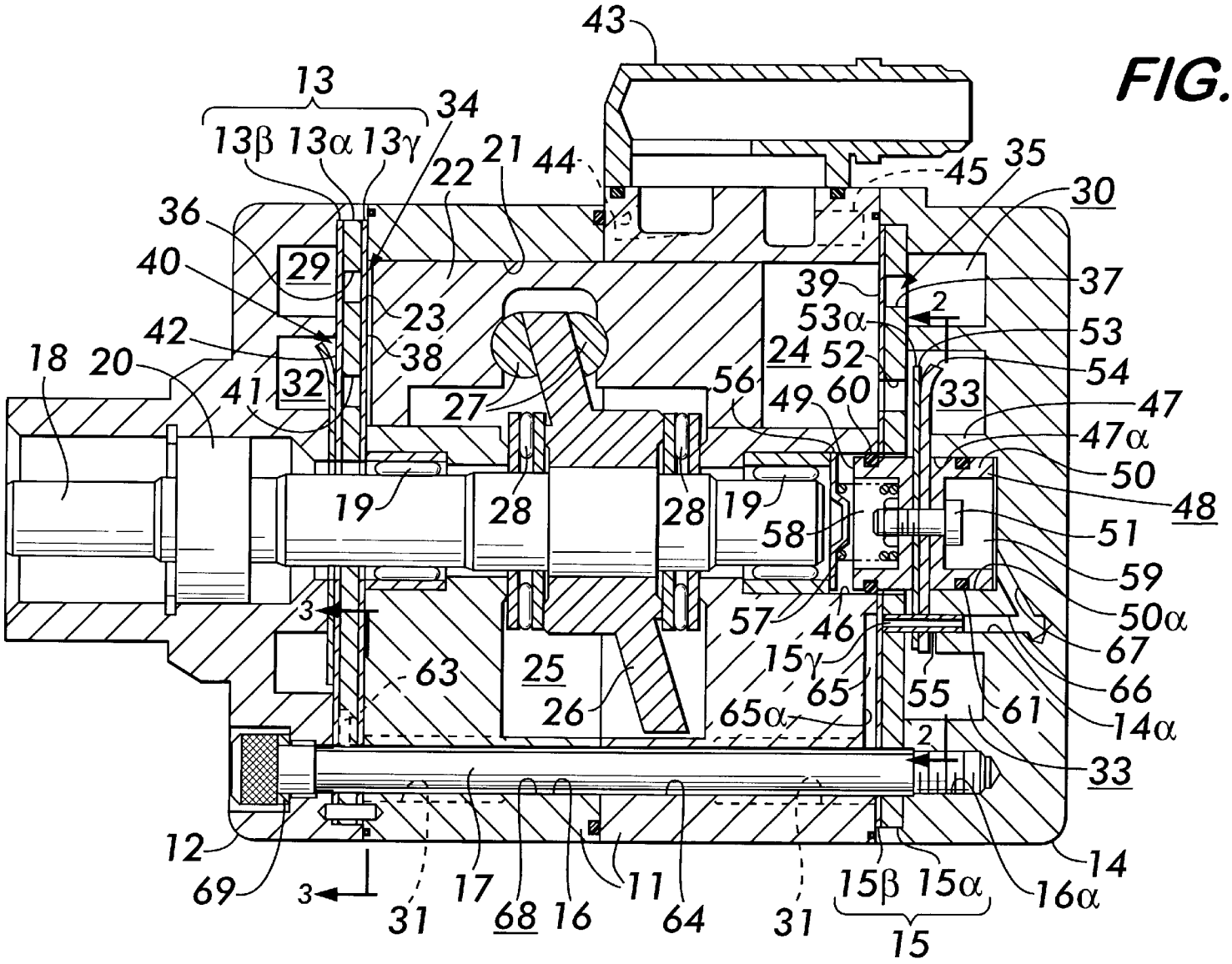
FIG. 1 is a vertical cross-sectional diagram of a twin-head piston-type compressor that is constructed according to a first embodiment of the invention.

Referring now to the drawings, wherein like reference numerals designate corresponding structure throughout the views, and referring in particular to FIG. 1, a pair of cylinder blocks 11 are connected to each other across opposite edges. Front housing 12 is connected to the front edge of cylinder block 11 through a front-side valve formation body 13. Front-side valve formation body 13 is constructed by superimposing discharge valve plate 13β on the front side of valve plate 13α and intake valve plate 13γ on the rear side of the valve plate. Rear housing 14 is connected to the rear edge of cylinder block 11 through rear-side valve body 15. Rear-side valve body 15 is constructed by superimposing intake valve plate 15β on the front side of valve plate 15α.

Multiple bolt insertion holes 16 (of which only one is indicated in the figures) are bored in rear housing 14 from front housing 12 through cylinder blocks 11 and through valve formation bodies 13 and 15. Bolts 17 are inserted from the side of front housing 12 into bolt insertion holes 16. The tips of the bolts are screwed into screw holes 16α of rear housing 14. These bolts 17 serve to fix front housing 12 and rear housing 14 onto the two sides of cylinder block 11.

Drive shaft 18 is supported in a rotating manner on the centers of aforementioned cylinder block 11 and front housing 12 through a pair of radial bearings 19. Lip seal 20 is mounted between the front edge periphery of drive shaft 18 and front housing 12. And, drive shaft 18 is connected in an operating manner to an external drive source, such as a vehicle engine, through a clutch (not shown in the figure). When the clutch is engaged, the drive force from the external drive source is transmitted and the drive shaft is rotated and driven.

Multiple cylinder bores 21 are bored and formed at prescribed intervals on the same circumference between the two edges of cylinder block 11 in such a way that the cylinder bores extend in parallel to aforementioned drive shaft 18. Twin-head pistons 22 are fitted and supported inside cylinder bores 21 in a reciprocal-moving manner. Compression chamber 23 (front side) and compression chamber 24 (rear side) are formed inside cylinder bores 21 between the two edges of the pistons and valve bodies 13 and 15.

Crank chamber 25 is formed on a partitioned basis between aforementioned cylinder blocks 11. Tilted plate 26 is locked and fixed onto drive shaft 18 inside crank chamber 25. The outer circumference of the tilted plate is attached to the center of piston 22 through shoe 27. The rotation of drive shaft 18 causes piston 22 to move reciprocally through tilted plate 26. A pair of thrust bearings 28 are provided between the two edges of tilted plate 26 and the inner surfaces of cylinder blocks 11. Tilted plate 26 is held between cylinder blocks 11 through thrust bearings 28. Crank chamber 25 is connected to an external cooling medium circuit through an intake flange (not shown in the figure) and forms a suction pressure area.

Front-side intake chamber 29 and rear-side intake chamber 30 are formed in a ring on a partitioned basis on the outer circumference of the aforementioned front housing 12 and rear housing 14. Intake passage 31 is formed in cylinder block 11 and two valve formation bodies 13 and 15, and the intake passage connects the aforementioned front-side intake chamber 29 and the rear-side intake chamber 30 to crank chamber 25.

Front-side discharge chamber 32 and rear-side discharge chamber 33 are formed in a ring on a partitioned basis on the inner circumference of front housing 12 and rear housing 14. Discharge flange 43 is joined and fixed to the outer circumference surface of cylinder block 11 on the rear side. The aforementioned front-side discharge chamber 32 and rear-side discharge chamber 33 are connected to discharge flange 43 through communicating ducts 44 and 45, respectively. Communicating ducts 44 and 45 merge inside discharge flange 43 and are connected to an external cooling medium circuit (not shown in the figure).

Front-side intake valve mechanism 34 and rear-side intake valve mechanism 35 are formed on valve plates 13α and 15α of the aforementioned valve bodies 13 and 15 and on discharge valve formation plates 13*b*. These intake valve mechanisms are formed into intake holes 36 and 37 and intake valve formation plates 13γ and 15β that correspond to cylinder bores 21. They are provided with intake valves 38 and 39, which open and close intake holes 36 and 37. As piston 22 moves from the upper dead point to the lower dead point, the action of intake valve mechanisms 34 and 35 causes cooling gas to be introduced into compression chambers 23 and 24 from intake chambers 29 and 30.

Front-side discharge valve mechanism 40 is formed on valve plate 13α of aforementioned front-side valve formation body 13 and on intake valve formation plate 13γ. This mechanism is made into discharge holes 41 and discharge valve formation plates 13γ that correspond to cylinder bores 21. They are provided with fixed discharge valves 42, which open and close discharge holes 41. As piston 22 moves from the lower dead point to the upper dead point, the action of discharge valve mechanism 40 causes cooling gas inside the front-side compression chambers to be compressed to a prescribed pressure and to be discharged to front-side discharge chamber 32.

The following describes the startup shock absorber apparatus that is applied to the twin-head piston-type compressor of the above constitution.

As shown in FIGS. 1 and 2, housing hole 46, which has a circular lateral cross-section, is formed from rear-side cylinder block 11 to rear-side valve formation body 15. The front-side inner circumference of housing hole 46 supports the rear side of the aforementioned drive shaft 18 through radial bearing 19. Spool support unit 47, which has an approximate cylindrical shape, protrudes from the inner wall of rear housing 14 in rear-side discharge chamber 33. Both spool support unit 47 and the aforementioned housing hole 46 are laid out on the same axial line.

Spool 48 is composed of first and second components 49 and 50, which constitute cylinders with bottoms. Components 49 and 50 are integrated by bolt 51 in such a way that their bottoms are positioned opposite each other. First component 49 is inserted into the aforementioned housing hole 46. Second component 50 is aligned with inner circumference surface 47α, whose outer circumference surface 50α as a coupling circumferential surface is the coupling circumferential surface of spool support unit 47; and the second component is inserted into spool support unit 47. Because the outer circumferential surface of first component 49 and the outer circumferential surface 50α of second component 50 are guided in an axial line direction by the inner circumferential surface of housing hole 46 and by the inner circumferential surface of spool 47α of support unit 47, respectively, spool 48 can move relative to rear-side valve formation body 15 in an approaching and receding direction.

Rear-side discharge holes 52 are formed in valve plate 15α and intake valve formation plate 15β of rear-side valve formation body 15 in correspondence to the aforementioned cylinder bores 21. Moving discharge valve 53, along with retainer 54, is held between components 49 and 50 of spool 48. Multiple open/close units 53α, corresponding to rear-side discharge holes 52 are formed in a detachable manner on the outer circumference of the moving discharge valve. Guide pin 55 is inserted into a part of moving discharge valve 53 and retainer 54 with some free play. One end of guide pin 55 is housed in pin housing hole 14α, which is bored into rear housing 14. The other end of the guide pin is housed in pin housing hole 15γ, which goes through rear-side valve formation body 15. Therefore, the rotation of both moving discharge valve 53 and retainer 54 is regulated by guide pin 55 so that the moving discharge valve and the retainer can move only in an axial line direction.

Spring seat 56 is connected and placed at the rear end of the aforementioned radial bearing 19 on the rear side. Spring 57, which is an energizing means, is mounted between spring seat 56 and the front side of first component 49. As shown in FIG. 1, spool 48 is energized and moved backwards by the energizing force of spring 57, and moving discharge valve 53 is positioned in a non-operating position away from rear-side discharge hole 52. The location of the non-operating position is determined by the butting of the backside of the aforementioned retainer 54 and the edge surface of spool support unit 47. In the condition in which the non-operating position has been determined, the provision of some gap (clearance k; more on this later) is assured between the rear edge surface of second component 50 and the inner bottom surface of spool support unit 47, which is positioned opposite the rear edge surface.

First control chamber 58 is formed on the front side of spool 48 in such a way that the inner space of the aforementioned housing hole is surrounded by spring seat 57 and first component 49. First control chamber 58 is connected to crank chamber 25 through the gap in radial bearing 19 on the rear side. The second control chamber 59 is formed and surrounded by the back side of the aforementioned second component 50 and by spool support unit 47.

First seal ring 60, which has a ring shape, is attached to the outer circumference of first component 49 in the aforementioned spool 48. The pressing of first seal ring 60 onto the inner circumferential surface of housing hole 46 in a ring-shaped area seals first control chamber 58 and rear-side discharge chamber 33, i.e., seals the rear-side discharge chamber in which crank chamber 25 as a suction pressure area and moving discharge valve 53 are provided. Second seal ring 61, which forms a ring shape as a sealing component, is attached to outer circumferential surface 59α of second component 50. The pressing of second seal ring 61 onto inner circumferential surface 47α of spool support unit 47 in a ring-shaped area seals second control chamber 59 and rear-side discharge chamber 33.

One of the front-side compression chambers 23 (23A) is connected to the aforementioned second control chamber 59 through pressure supply passage 68, which is composed of first through fifth passages 63–67. Consequently, the cooling gas inside front-side compression chamber 23A is supplied to second control chamber 59 through pressure supply passage 68 by the reciprocating motion of piston 22.

Specifically, as shown in FIG. 3, first passage 63 is constituted by providing groove 63α on the backside of valve plate 13α of front-side valve formation body 13 so that groove 63α is blocked by intake valve formation plate 13γ. Groove 63α serves to connect the aperture peripheral edge of cylinder bore 21, which is indicated by intake formation plate 13γ, to the peripheral edge of bolt insertion hole 16. Therefore, the aforementioned front-side compression chamber 23A and one of the bolt insertion holes 16, which is second passage 64, are connected by the aforementioned first passage 63. Compared with the second through fifth passages 64–67, first passage 63 has a narrower passage cross-section. This serves as a choke that throttles the cooling gas that flows inside pressure supply passage 68.

The aforementioned first passage 63 is connected to the aperture peripheral edge of cylinder bore 21, which is formed around intake valve 38, and opens on the edge side that corresponds to the upper dead point of cylinder bore 21. Therefore, whether piston 22 is located at the upper dead point position or the lower dead point position or at any stroke position in between, front-side compression chamber 23A and second passage 64 are always connected to each other. It should be noted that a seal ring 69 is provided between front housing 12 and the head of through bolt 17, which corresponds to the aforementioned second passage 64, so that the inner space of second passage 64 is sealed off from the outside of the compressor.

Third passage 65 is constituted by providing groove 65α on the backside of rear-side cylinder block 11. Intake valve formation plate 15β of rear-side valve formation body 15, by means of intake valve 37, clear holes, and other non-formation components, abuts the formation component of groove 65α. This blocks groove 65α. Groove 65α is bored from the aperture peripheral edge of bolt insertion hole 16, which appears on the backside of cylinder block 11 on the rear side, to a position opposite pin housing hole 15γ of rear-side valve plate 15. Therefore, a second passage 64 and pin housing hole 15γ of rear-side valve formation body 15 are connected to each other through third passage 65.

The aforementioned guide pin 55 has a cylindrical shape. Therefore, fourth passage 66 is formed when pin housing holes 14α and 15γ are connected to each other through the inner space of guide pin 55. Because guide pin 55 is pressed and fixed relative to at least one of pin housing holes 14α and 15γ, even when the aforementioned moving discharge valve 53 and retainer 54 move in an axial line direction, the guide pin never moves in tandem in the same direction with these units. Furthermore, guide pin 55 will never come off pin housing hole 14α or 15γ to cause cuts in pressure supply passage 68.

In rear housing 14, fifth passage 67 is bored from the inner bottom side of spool support unit 47. Fifth passage 67 serves to connect pin housing hole 14α of the aforementioned fourth passage 66 to second control chamber 59.

The following explains the operation of the twin-head piston-type compressor of the aforementioned embodiment.

When the compressor is stopped, spool 48 is moved backwards by the energizing force of spring 57. This causes moving discharge valve 53 to be positioned in the non-operating position. When the clutch is engaged in this condition and the drive force is transmitted from an external drive source, such as a vehicle engine, to drive shaft 18, the reciprocating motion of piston 22 begins in conjunction with the rotation of tilted plate 26.

When the reciprocating motion of piston 22 begins, a cycle (the normal compression operation) consisting of the suction of cooling gas from intake chamber 29, the compression in compression chamber 23, and the discharge to discharge chamber 32 begins in front-side compression chambers 23 in conjunction with the reciprocating motion of piston 22.

On the other hand, the cooling gas, which is drawn from rear-side intake chamber 30 to compression chamber 24 in conjunction with the reciprocating motion of piston 22 is discharged to discharge chamber 33 while undergoing little compression, due to the fact that the moving discharge valve is positioned at the non-operating position.

The aforementioned second control chamber 59 is connected to one of the compression chambers 23A on the front side through pressure supply passage 68. Therefore, when the reciprocating motion of piston 22 is started by the activation of the compressor, the cooling gas inside compression chamber 23A is supplied to second control chamber 59 through pressure supply passage 68. The pressure of cooling gas inside control chamber 23A changes from the low pressure in the vicinity of the suction pressure to the high pressure in the vicinity of the discharge pressure as piston 22 move in a reciprocating motion.

The change in the pressure that is supplied to second control chamber 59 is moderated when the cooling gas passes through first passage 63. Consequently, an approximately average pressure (intermediate pressure) of compression chamber 23A, which is the average of pressure levels and represents the motion of piston 22 for one stroke, is supplied to second control chamber 59. Moreover, the pressure supplied to second control chamber 59 is throttled by first passage 63. This moderates any rise in pressure inside second control chamber 59.

After a prescribed length of time has passed since the compressor was started and the difference between the pressure inside second control chamber 59 and the suction pressure inside first control chamber 58 increases in excess of the energizing force of spring 57, spool 48 is gradually moved forward, as shown in FIG. 4, and moving discharge valve 53 is positioned in the operating position. Also, in rear-side compression chamber 24, the normal compression operation is started by the reciprocating motion of piston 22.

Thus, for a few seconds after the compressor is started, the cooling gas is bypassed from rear-side discharge hole 52 to rear-side discharge chamber 33. This moderates the increase in compression load that occurs on rear-side compression chamber 24 and that acts on piston 22, and, as a result, suppresses the occurrence of noise and vibrations that would otherwise originate from the startup shock of the compressor.

Similarly, when the compressor is started, any cooling medium that has collected inside rear-side compression chamber 24 is eliminated to the outside of compression chamber 24 by the reciprocating motion of the aforementioned piston 22 when moving discharge valve 53 moves from its non-operating position to the operating position. This prevents any liquid compression in rear-side compression chamber 24 and thus reduces the noise and vibrations that occur when the compressor is started.

On the other hand, when the clutch is disconnected, the transmission of drive force from an external drive source, such as a vehicle engine, to drive shaft 18 is stopped. This stops the reciprocating motion of piston 22 as well as the supply of pressure from front-side compression chamber 23A to second compression chamber 59. Therefore, the pressure from second compression chamber 59 is released to front-side compression chamber 23A through pressure supply passage 68, and, ultimately, to crank chamber 25 through the side clearance between piston 22 and cylinder bore 21, and this reduces the pressure. And, when the difference between the pressure inside second control chamber 59 and the pressure inside first control chamber 58 falls below the energizing force of spring 57, spool 48 is moved backwards, and moving discharge valve 53 is positioned in the non-operating position. This is shown in FIG. 1.

The embodiment mode as constituted above produces the following effects:

(1) By a simple constitution, wherein first control chamber 58 is opened to crank chamber 25, and the pressure from front-side compression chamber 23A is supplied to second compression chamber 59 through a fixed throttle (first passage 63), it is possible to move moving discharge valve 53 between its non-operating position and its operating position as the compressor is started or stopped. Therefore, in contrast to previous inventions published in the Japanese Kokai patent, it is necessary neither to provide electromagnetic valves on the pressure supply passage nor to provide a control computer for controlling the electromagnetic valve as the compressor is started or stopped. As a result, the startup shock absorber, and ultimately the compressor, can be constituted simply and inexpensively.

(2) The difference between the pressure of front-side compression chamber 23A that is supplied to second control chamber 59 and the suction pressure inside first control chamber 58 is smaller than the difference between the discharge pressure and the suction pressure. This reduces the motion of spool 48 from its non-operating position to operating position and is effective in reducing the increase in the pressure load that acts on piston 22.

Moreover, stopping the compressor quickly eliminates the small pressure difference between second control chamber 59 and first control chamber 58. This permits the rapid transfer of moving discharge valve 53 from its operating position to the non-operating position. Therefore, even if the compressor is restarted shortly after it is stopped, the startup shock absorber is capable of causing moving discharge valve 53 to move from its non-operating position. This improves the responsiveness of the startup shock absorber relative to the restarting operation of the compressor.

(3) When the compressor is stopped, the pressure inside second control chamber 59 is released to front-side compression chamber 23A (crank chamber 25) through pressure supply passage 68 and is reduced. Thus, pressure supply passage 68 doubles as a passage that supplies control pressure to second control chamber 59 and as a passage that releases pressure. Therefore, in contrast to previous inventions published in the Japanese Kokai Patent, it is not necessary to connect two separate passages, one for supplying pressure to the control chamber and the other for releasing pressure from the control chamber. This simplifies the constitution of the circuit.

(4) Aforementioned pressure supply passage 68 is connected to front-side compression chamber 23A on the edge side corresponding to the upper dead point of cylinder bore 21. Therefore, moving discharge valve 53 can be moved accurately to its non-operating position as the compressor is stopped. In other words, suppose that pressure supply passage 68 is opened to the inner circumference surface of cylinder bore 21 or, more specifically, to front-side compression chamber 23A on the inner circumference surface of cylinder bore 21 within the stroke range of piston 22. In such a case, as the compressor is stopped, piston 22 could stop along the circumference surface at the position that blocks the opening. This makes it impossible to release the pressure inside second control chamber 59 rapidly to front-side compression chamber 23A and thus could delay the motion of moving discharge valve 53 from its operating position to its non-operating position.

(5) Second seal ring 61 is provided on the outer circumference of second component 50 of spool 48. Second control chamber 59 and rear-side discharge chamber 33 are sealed by second seal ring 61. Therefore, during the normal compression operation of rear-side compression chamber 24, the high-pressure cooling gas inside the rear-side discharge chamber 33 can be prevented from flowing into second control chamber 59 due to the difference between this pressure and the pressure inside first control chamber 58. In other words, second control chamber 59 acts as a discharge pressure atmosphere and increases the pressure difference between itself and first control chamber 58. This can prevent any impairment of the rapid transfer of moving discharge valve 53 from its operating position to its non-operating position, as stated in Effect (2) above.

(6) Rear-side discharge chamber 33 and crank chamber 25 are sealed by first seal ring 60. This causes the cooling gas, discharged from front-side discharge chamber 32 to an external cooling medium circuit, to flow into rear-side discharge chamber 33 through passage 45; it prevents the cooling gas from flowing into crank chamber 25 through the clearance between spool 48 and housing hole 46. Thus, the high-pressure cooling gas, which would otherwise be supplied to an external cooling medium circuit, is allowed to circulate within the compressor. This prevents a reduction in compression efficiency due to a re-expansion of the gas inside crank chamber 25 or a reduction in the responsiveness of the vehicle air conditioning equipment. In other words, this eliminates the need for the check valve that is provided on passage 45 and that opens and controls passage 45 only when moving discharge valve 53 is located at its operating position in order to solve this problem. Consequently, the compressor can be constituted simply and inexpensively.

(7) First passage 63 is constituted by constructing groove 63α in valve plate 13α that comprises front-side valve formation body 13 and by blocking groove 63α with intake valve formation plate 13γ. Constructing groove 63α accurately for throttling purposes on valve plate 13α is easier than boring small holes through cylinder block 11 or housing units 12 and 14. Consequently, this method allows for the simple construction of first passage 63.

(8) First passage 63, which functions as a throttle, is provided at the position through which pressure supply passage 68 and front-side compression chamber 23A are connected. This can minimize any influence from the volume of pressure supply passage 68 on the dead volume (compression ratio) in front-side compression chamber 23A. This eliminates the need for adjusting the dead volume of front-side compression chamber 23A in conjunction with other compression chambers 23 and 24. Therefore, manufacturing operations such as inserting piston 22 of a different stroke only into cylinder bore 21 of front-side compression chamber 23A or modifying the bore diameter of cylinder bore 21 can be eliminate also.

(9) During the motion of spool 48, aforementioned first and second seal rings 60 and 61 slide on the inner circumference of housing hole 46 or spool support unit 47 and produce a motion resistance. This further reduces the speed of motion of moving discharge valve 53 from its non-operating position to its operating position, and thus more effectively moderates the increase in compression load that acts on piston 22.

The Embodiment of FIG. 5

FIG. 5 shows a compressor that is constructed according to a second embodiment of the invention. In this embodiment, the aforementioned first passage 63 comprises a first passage 63*a* (not shown) having substantially the same passage cross-sectional area as other passages 64–67 and does not act as a cooling gas throttle. Therefore, a throttle passage 71, distinct from any of the aforementioned first through fifth passages, 63*a*–67, is provided inside pressure supply passage 68.

Specifically, the aforementioned fifth passage 67 is bored on spool support unit 47 from its inner circumference side. Even when spool 48 moves between its operating position and its non-operating position, fifth passage 67 always opens on inner circumference side 47α of spool support unit 47, which is positioned toward second control chamber 59, away from second seal ring 61.

The aforementioned throttle passage 71 comprises clearance K between inner circumference side 47α of the aforementioned spool support unit 47 and outer circumference side 50α of second component 50 of spool 48, which is positioned opposite to the spool support unit. The aforementioned fifth passage 67 and second control chamber 59 are connected by throttle passage 71. Clearance K is set to 20–100 microns, as an example, with the result that throttle passage 71 has a smaller passage cross section than the aforementioned first through fifth passages, 63*a*–67. This causes the cooling gas, supplied from front-side compression chamber 23A into second control chamber 59, to be throttled by throttle passage 71.

This embodiment mode produces the following effects in addition to the effects produced by the aforementioned embodiment mode 1:

Even if foreign objects that occur in the cooling gas collect in throttle passage 71, the motion of spool 48 relative to spool support unit 47 makes the collected state unstable. Therefore, the motion of the cooling gas within pressure supply passage 68 can ultimately eliminate the foreign objects to the outside of throttle passage 71. In this manner a self-cleaning action can be expected to occur, and this makes foreign objects unlikely to remain collected within throttle passage 71. As a result, the clogging by foreign objects of pressure supply passage 68 due to the smaller passage cross section of the throttle (71) compared with the passage cross section of other passages 63*a*–67 can be reduced, and this improves the reliability of the present startup shock absorber apparatus.

The Embodiment of FIG. 6

FIG. 6 shows a compressor that is constructed according to a third embodiment of the invention. This embodiment eliminates the aforementioned constitution of first seal ring 60. Therefore, when moving discharge valve 53 is not in its operating position, rear-side discharge chamber 33 and first control chamber 58 (crank chamber 25) are connected through the clearance between first component 49 and housing hole 46. It should be noted that when moving discharge valve 53 is in the operating position, the pressing of the inner circumference of moving discharge valve 53 onto the opening of housing hole 46, which appears on rear-side valve formation body 15, shuts off the connection between first control chamber 58 and rear-side discharge chamber 33.

Check valve 75, acting as a control valve, is provided on the aforementioned communicating duct 45. When rear-side discharge chamber 33 is under low pressure, the check valve closes communicating duct 45; when the rear-side discharge chamber is under high pressure in the vicinity of the discharge pressure, the check valve opens communicating duct 45.

When moving discharge valve 53 is moved to its operating position after the compressor is started, the high-pressure cooling gas discharged from front-side discharge chamber 32 is discharged to an external cooling medium circuit through communicating duct 44 and discharge flange 43. Because the pressure inside rear-side discharge chamber 33 is low during this time, check valve 75 shuts off communicating duct 45. Therefore, the high-pressure cooling gas discharged from front-side discharge chamber 32 never flows into rear-side discharge chamber 33 through communicating ducts 44 and 45.

When moving discharge valve 53 is moved to the operating position and the normal compression operation begins in rear-side compression chamber 24, the pressure inside rear-side discharge chamber 33 increases. Therefore, as indicated by the two-dot chain line, check valve 75 is pushed up by this pressure which causes communicating duct 45 to open. The discharge cooling gas from rear-side discharge chamber 33 combines, in discharge flange 43, with the cooling gas discharged from front-side discharge chamber 32 and is discharged to an external cooling circuit.

This embodiment mode produces the following effects in addition to the effects produced by the aforementioned embodiment mode 1:

(1) Present embodiment mode eliminates the constitution of first seal ring 60. Also, when moving discharge valve 53 moves from the non-operating position to the operating position, the pressure inside rear-side discharge chamber 33 increases gradually. For this reason, the difference between the pressures inside rear-side discharge chamber 33 and crank chamber 25 causes the liquid coolant, discharged into rear-side discharge chamber 33 as described in aforementioned Embodiment Mode 1, to be discharged to crank chamber 25 through the clearance between first component 49 and housing hole 46. This enhances the aforementioned liquid compression prevention effect and thus can effectively reduce the noise and vibrations that originate from the liquid compression.

(2) A check valve 75 is provided in communicating duct 45. This prevents any inflow of high-pressure cooling gas from front-side discharge chamber 32 to rear-side discharge chamber 33 when moving discharge valve 53 is not at the operating position. Therefore, the problem of internal circulation can be avoided, wherein the high-pressure cooling gas is introduced into crank chamber 25 through the clearance between first component 49 and housing hole 46, is re-expanded in crank chamber 25, and returned to the compression cycle. This prevents a reduction in compression efficiency for the compressor and a decrease in the responsiveness of the vehicle air conditioning system owing to the fact that the high-pressure cooling gas is not immediately supplied to the external cooling circuit after the compressor is started.

It should be noted that the present invention may also be implemented in the following modes to an extent that does not deviate from the spirit of the invention:

(1) As shown in FIG. 7, first component 49 of spool 48 can be deleted from the aforementioned third embodiment. In addition, moving discharge valve 53 and retainer 54 can be directly fixed onto second component 50 by means of bolt 51. In this case the space on the front side of spool 48 in housing hole 46 and rear-side discharge chamber 33 becomes first control chamber 58. Also, crank chamber 25 and first control chamber 58 (rear-side discharge chamber 33) can be connected by constructing a bypass passage 77 in rear-side cylinder block 11 and by using bypass passage 77, without requiring the use of rear-side radial bearing 19.

(2) Second control chamber 59 can be connected to front-side compression chambers 23. For example, even when the aforementioned pressure supply passage 68 opens on the inner circumference surface of cylinder bore 21 within the stroking range of piston 22, because second control chamber 59 is connected to multiple front-side compression chambers 23, front-side compression chambers 23, having different stroking positions for pistons 22, can rapidly release the pressure inside second control chamber 59 to the front-side compression chambers 23. Ideally, the position at which the openings inside front-side compression chambers 23 are not blocked simultaneously by the circumference surface of pistons 22 should be determined and pressure supply passage 68 should be opened at that position.

(3) In the rear-side discharge valve mechanism, fixed discharge valve 40 and moving discharge valve 53 can be provided on a mixed basis so that front-side compression chamber 24, corresponding to fixed discharge valve 40, and second control chamber 59 are connected to each other through pressure supply passage 68. In this case the fixed discharge valve can be associated with a plurality of rear-side discharge holes 41, and second control chamber 59 can be connected to multiple rear-side compression chambers 24 with which fixed discharge valve 40 is associated, as shown in Example (1). When the invention is implemented in this manner, even if there is a clearance between first component 49 and housing hole 46 as in Embodiment Mode 3, the cooling gas (high pressure) discharged from compression chamber 24 with which fixed discharge valve 40 is associated, undergoes a pressure reduction due to the suction pressure inside first control chamber 58 (so that the resulting pressure is lower than the intermediate pressure acting inside second control chamber 59). This creates a pressure difference between first control chamber 58 and second control chamber 59 located across spool 48 and can thus produce a startup shock absorption effect.

(4) Front-side discharge valve mechanism 34 can be substituted for moving discharge valve (53) and rear-side discharge valve mechanism 53 can be substituted for fixed discharge valve (40) in order to incorporate the startup shock absorber apparatus into the front side of the compressor.

(5) A through hole can be created in cylinder block 11 on the front side and the through hole can be opened on the inner circumference surface of cylinder bore 21 in front-side compression chamber 23.

(6) For example, spool support unit 47 can be made into a column so that second component 50 of spool 48 can be fitted from the outside onto the outer circumference of spool support unit 47. In other words, items 47 and 50 can be configured in a reverse insertion relationship.

(7) First seal ring 60 can be provided on the inner circumference side of housing hole 46.

(8) Second seal ring 61 can be provided on inner circumference side 47*a* of spool support unit 47.

(9) A groove can be made on the edge side of front-side cylinder block 11 and the groove can be closed using front-side valve formation body 13 in order to construct first passage 63.

(10) The invention can be implemented in a single-head piston-type compressor. In this case moving discharge valve 53 and fixed discharge valve 40 can be provided on a mixed basis, and the control chamber for cylinder bore 21, with which fixed discharge valve 40 is associated, can be connected to second control chamber 59.

(11) A choke can be constructed by inserting a choke pin into pressure supply passage 68.

(12) Pressure supply passage 68 can be constructed using external pipes that are provided external to the compressor.

The following describes the technological philosophy underlying the present invention as can be determined from the above embodiment modes. The aforementioned valve formation plate 13 is made by stacking several plates 13α–13γ. Aforementioned pressure supply passage 68 (63) is constructed by boring groove 63α on at least one side of oppositely placed plates (13α, 13β), (13α, 13γ).

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A compressor that is designed so as to minimize mechanical disturbances such as shock and vibration during start-up, comprising:

a plurality of pistons, each of said pistons being positioned for movement within a plurality of cylinder bores in order to compress a gas;

motive means for driving said pistons;

sensing means for sensing when the compressor is in a start-up phase by sensing a pressure at an upper dead point of at least one of said cylinder bores, at least a portion said sensing means being located at said upper dead point so as to be operative regardless of the position of said pistons; and pressure relief means, responsive to said sensing means, for relieving pressure in at least one of said cylinder bores when said sensing means indicates that the compressor is in the start-up phase, whereby shock and vibration are minimized during the start-up.

2. A compressor according to claim 1, wherein said sensing means comprises a control chamber and a pressure supply passage connecting a cylinder bore to said control chamber, and wherein the passage is constructed to restrict the flow of gas therethrough, so that pressure in said control chamber will approximate an average pressure in said cylinder bore during long term operation of the compressor after start-up.

3. A compressor according to claim 2, wherein said pressure supply passage has a choke positioned therein.

4. A compressor according to claim 3, wherein said choke comprises at least a portion of said pressure supply passage being formed having a narrower cross-sectional area than the rest of said pressure supply passage which is formed having substantially the same cross-sectional area, to restrict the flow of gas therethrough.

5. A compressor according to claim 4, wherein said pressure supply passage further comprises a first passage formed proximate said cylinder bore, said first passage having a narrower cross-sectional area than the rest of said pressure supply passage, to restrict the flow of gas therethrough.

6. A compressor according to claim 4, wherein said pressure supply passage further comprises a throttle passage formed proximate said control chamber, said throttle passage having a narrower cross-sectional area than the rest of said pressure supply passage, to restrict the flow of gas therethrough.

7. A compressor according to claim 2, wherein said pressure supply passage is sized at a substantially constant cross-sectional area.

8. A compressor according to claim 2, wherein said pressure relief means comprises a moving discharge valve that is associated, on a detachable basis, with at least one discharge hole of the compressor and which is moved by the pressure from at least one of said cylinder bores, said moving discharge valve being constructed to be positioned in an operating position in which said moving discharge valve closes said discharge holes when the pressure in said control chamber is indicative of long term operation, and to be positioned in a non-operating position, in which said moving discharge valve opens said discharge holes, when the pressure in said control chamber is indicative of startup conditions.

9. A compressor according to claim 1, wherein said pressure relief means comprises a moving discharge valve that is associated, on a detachable basis, with at least one discharge hole of the compressor and which is moved by the pressure from at least one of said cylinder bores, said moving discharge valve being constructed to be positioned in an operating position in which said moving discharge valve closes said discharge holes when said sensing means is indicative of long term operation, and to be positioned in a non-operating position, in which said moving discharge valve opens said discharge holes, when said sensing means is indicative of start-up conditions.

10. A piston-type compressor, comprising:

front and rear housing units that are joined and fixed to the edge of a cylinder block through valve formation bodies a plurality of cylinder bores, each of which holds a piston and is formed on said cylinder block;

intake and discharge chambers that are constructed on a partition basis in said housing unit, such that the reciprocating motion of said pistons draws the cooling-medium gas from said intake chamber into a compressing chamber in said cylinder bore and, subsequently, the gas is pumped out into said discharge chamber through discharge holes that are formed on said valve bodies;

a spool support unit that is placed in said discharge chamber;

a spool that is fitted onto and supported by said spool support unit and that can be moved relative to said valve bodies in a direction in which said spool can move toward and away from said valve bodies;

moving discharge valves mounted on said spool and that are associated, on a detachable basis, with at least one of said discharge holes located on said valve bodies and that, in tandem with said spool, can move by the pressure from at least one of said cylinder bores between an operating position, in which said moving discharge valves close said discharge holes, and a non-operating position, in which said moving discharge valves open said discharge holes;

an energizing means that energizes said spool so that the movable discharge valve is placed at the non-operating position;

a first control chamber that is formed on the front side of said spool and that is connected to a suction pressure area;

a second control chamber that is surrounded by said spool and said spool support unit and that is formed on a partitioned basis on the back side of said spool;

a sealing unit that is placed between the coupling sides of said spool and said spool support unit and that seals said second control chamber and said discharge chamber;

a pressure supply passage that directly connects said second control chamber to said compression chamber on the cylinder bore which is not associated with a movable discharge valve, such that, when the compressor is started, said pressure supply passage supplies the pressure inside the compression chamber to said second control chamber and, when the compressor is stopped, said pressure supply passage releases the pressure inside said second control chamber to the compression chamber; and a choke that is provided on said pressure supply passage.

11. A startup shock absorber according to claim 10, wherein said choke is provided in the interior of said valve formation bodies.

12. A startup shock absorber according to claim 10, wherein said choke comprises a clearance between said spool support unit and the coupling lateral side that is opposite to said spool, such that said pressure supply passage, at a middle position on the passage, opens at the coupling lateral side of said spool support unit relative to said spool.

13. A startup shock absorber according to claim 10, wherein said pressure supply passage is connected to said compression chamber on the edge side that corresponds to the upper dead point of said cylinder bore.

14. A startup shock absorber according to claim 10, wherein said discharge chamber and said suction pressure area in which said movable discharge valves are provided are constituted in such a way that said movable discharge valves are connected in the non-operating state, such that the control valves, that open the communicating duct when the movable discharge valves are placed in the operating state, are provided on the communicating duct that connects said discharge chamber to the discharge flange.

15. A compressor according to claim 10, wherein said choke comprises at least a portion of said pressure supply passage being formed having a narrower cross-sectional area than the rest of said pressure supply passage which is formed having substantially the same cross-sectional area, to restrict the flow of gas therethrough.

16. A compressor according to claim 15, wherein said at least a portion of said pressure supply passage being formed having a narrower cross-sectional area comprises a first passage formed proximate said cylinder bore, said first passage having a narrower cross-sectional area than the rest of said pressure supply passage, to restrict the flow of gas therethrough.

17. A compressor according to claim 16, wherein said first passage is formed in one of said valve formation bodies.

18. A compressor according to claim 15, wherein said at least a portion of said pressure supply passage being formed having a narrower cross-sectional area comprises a throttle passage formed proximate said control chamber, said throttle passage having a narrower cross-sectional area than the rest of said pressure supply passage, to restrict the flow of gas therethrough.

19. A compressor according to claim 18, wherein said throttle passage comprises a clearance formed between an inner circumference side of said spool support unit and an outer circumference side of said spool.

20. A compressor that is designed so as to minimize mechanical disturbances such as shock and vibration during start-up, comprising:

a plurality of pistons, each of said pistons being positioned for movement within a plurality of cylinder bores in order to compress a gas;

motive means for driving said pistons;

sensing means for sensing when the compressor is stopped, by sensing pressure at an upper dead point of at least one of said cylinder bores, at least a portion of said sensing means being located at said upper dead point so as to be operative regardless of the position of the pistons when the compressor is stopped; and pressure relief means, responsive to said sensing means, for relieving pressure to at least one of said cylinders when said sensing means indicates that the compressor is stopped, whereby shock and vibration are minimized during the start-up.

21. A compressor according to claim 20, wherein said sensing means comprises a control chamber, and a pressure supply passage connecting a cylinder bore to said control chamber, and wherein the passage is constructed to restrict the flow of gas therethrough, so that pressure in said control chamber will approximate an average pressure in said cylinder bore during long term operation of the compressor after start-up.

22. A compressor according to claim 21, wherein said pressure supply passage has a choke positioned therein.

23. A compressor according to claim 21, wherein said pressure supply passage is sized at a substantially constant cross-sectional area.

24. A compressor according to claim 21, wherein said pressure supply passage comprises a plurality of individual passages, at least one of said individual passages being formed having a narrower cross-sectional area than the rest of said individual passages of said pressure supply passage which are formed having substantially the same cross-sectional area, to restrict the flow of gas therethrough.

25. A compressor according to claim 24, wherein said at least one of said individual passages being formed having a narrower cross-sectional area comprises a first passage formed proximate said cylinder bore, to restrict the flow of gas therethrough.

26. A compressor according to claim 24, wherein said at least one of said individual passages being formed having a narrower cross-sectional area comprises a throttle passage formed proximate said control chamber, to restrict the flow of gas therethrough.

27. A compressor that is designed so as to minimize mechanical disturbances such as shock and vibration during start-up, comprising:

a compressor housing having a cylinder block disposed between a front housing connected to said cylinder block through a front-side valve formation body and a rear housing connected to said cylinder block through a rear-side valve formation body;

a drive shaft rotatably disposed in said housing along a longitudinal axis of said housing;

a plurality of cylinder bores, each of which holds a piston and is formed on said cylinder block;

a cam plate for converting the rotating motion of said drive shaft to reciprocating motion of said pistons;

intake and discharge chambers that are constructed on a partition basis in said housing units, such that the reciprocating motion of said pistons draws the cooling-medium gas from said intake chamber into a compression chamber in said cylinder bore and, subsequently, the gas is pumped out into said discharge chamber through discharge holes that are form ed in said valve bodies;

a spool support unit having an approximate cylindrical shape and protruding from an inner wall of said rear housing into said discharge chamber;

a spool that is fitted onto and supported by said spool support unit and that can be moved relative to said valve bodies in a direction in which said spool can move toward and away from said valve bodies;

a control chamber formed between said spool, said spool support unit, and said rear housing;

a sealing unit that is placed between the coupling sides of said spool and said spool support unit and that seals said control chamber from said discharge chamber;

a pressure supply passage that directly connects said control chamber to said compression chamber on at least one of said cylinder bores such that, when the compressor is started, said pressure supply passage supplies the pressure inside said compression chamber to said control chamber and, when the compressor is stopped, said pressure supply passage releases the pressure inside said second control chamber to said compression chamber;

a moving discharge valve mounted on said moving spool, said moving discharge valve being moved by a pressure from at least one of said cylinder bores acting on said spool, said moving discharge plate being associated, on a detachable basis, with at least one discharge hole of said compressor, wherein said moving discharge valve is constructed to be positioned in an operating position in which said moving discharge valve come into contact with one of said valve formation bodies when the pressure in said control chamber is indicative of long term operation, and to be positioned in a non-operating position, in which said moving discharge valve is separated from one of said valve formation bodies, when the pressure in said control chamber is indicative of start-up conditions; and a choke that is disposed proximate said pressure supply passage to throttle the flow of gas therethrough.

28. A compressor according to claim 27, wherein said passage is formed from at least one of said plurality of cylinder bores at an upper dead point of said cylinder bore, such that a pressure is sensed regardless of the position of said pistons.

29. A compressor according to claim 27, wherein said choke comprises said passage having a plurality of individual passages, wherein at least one individual passage is formed having a narrower cross-sectional area than the rest of said individual passages of said pressure supply passage that are formed having substantially the same cross-sectional area, to restrict the flow of gas therethrough.

30. A compressor according to claim 29, wherein a first passage is formed proximate said cylinder bore having a narrower cross-sectional area to restrict the flow of gas therethrough.

31. A compressor according to claim 29, wherein a throttle passage is formed proximate said control chamber having a narrower cross-sectional area to restrict the flow of gas therethrough.

32. A compressor according to claim 31, wherein said throttle passage comprises a clearance formed between an inner circumference side of said spool support unit and an outer circumference side of said spool.

* * * * *